US010084222B1

(12) United States Patent
Chun et al.

(10) Patent No.: US 10,084,222 B1
(45) Date of Patent: Sep. 25, 2018

(54) RF FILTER FOR IMPROVING PIMD PERFORMANCE

(71) Applicant: ACE TECHNOLOGIES CORPORATION, Incheon (KR)

(72) Inventors: Dong-Wan Chun, Incheon (KR); Sung Soo Chung, Incheon (KR); Jung Geun Park, Seoul (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 9 days.

(21) Appl. No.: 15/593,238

(22) Filed: May 11, 2017

(30) Foreign Application Priority Data

Mar. 22, 2017 (KR) ..... 10-2017-0036230

(51) Int. Cl.

| | |
|---|---|
| ***H01P 7/10*** | (2006.01) |
| ***H01P 7/04*** | (2006.01) |
| ***H01P 1/207*** | (2006.01) |
| ***H01P 1/208*** | (2006.01) |

(52) U.S. Cl.
CPC ..... *H01P 1/207* (2013.01); *H01P 1/2084* (2013.01); *H01P 7/04* (2013.01); *H01P 7/10* (2013.01)

(58) Field of Classification Search
CPC ..... H01P 1/2084; H01P 1/207; H01P 7/10; H01P 7/04
USPC .... 333/219.1, 219, 202, 222, 223, 224, 225, 333/226, 203, 206, 207
See application file for complete search history.

(56) References Cited

U.S. PATENT DOCUMENTS

| | | | | |
|---|---|---|---|---|
| 2011/0128097 | A1* | 6/2011 | Park | H01P 7/10 333/219.1 |
| 2016/0072169 | A1* | 3/2016 | Lin | H01P 1/2084 333/202 |
| 2016/0351989 | A1* | 12/2016 | Bulja | H01P 11/008 |

* cited by examiner

*Primary Examiner* — Stephen E Jones

(57) ABSTRACT

An RF filter for improving PIMD performance includes: a housing having at least one cavity and a dielectric resonator held in the cavity; washers shaped as circular plates and made of metal that are joined to an upper and lower portion of the dielectric resonator; and a cover joined to the housing. A protrusion may be formed on one side of the washer to contact the cover or the housing, where the washer protrusion may increase in height along a direction moving away from the center.

18 Claims, 14 Drawing Sheets

RF FILTER FOR IMPROVING PIMD PERFORMANCE

TECHNICAL FIELD

The present invention relates to an RF filter, more particularly to an RF filter for improving PIMD performance.

BACKGROUND ART

Advances in communication services require faster data transmission speeds, which in turn require increasing system bandwidth, improving reception sensitivity, and minimizing interference from other communication systems. Thus, there is a continually growing demand for filters that provide the properties of wider bandwidth, smaller size, lower insertion loss, and higher rejection.

Filters using coaxial resonators are often used, due to the advantages they provide in terms of cost as compared with filters using dielectric resonators such as ceramic filters and monoblock filters. However, while base stations are being built for lower output and smaller sizes, as in the case of small cells, the existing coaxial resonator is limited in terms of how small a size it can have. As such, the use of the smaller-sized dielectric resonator such as the TM mode resonator is gaining popularity, especially for implementing ultra-small filters. However, the dielectric resonator entails the drawback that, because of a difference in thermal expansion coefficients between the dielectric resonator element and the housing, thermal contraction and expansion due to temperature changes can result in the dielectric resonator elements becoming unsecure or providing inadequate contact, which in turn may cause the properties of the filter to change.

Moreover, the coaxial resonator can provide several advantages. For example, the coaxial resonator is advantageous in making small size filters operating at lower frequencies. The coaxial resonator may also improve power handling, which may be important with a small size filter. Here, the air gap between the cover lid and top surface of conventional coaxial resonator may be replaced by a dielectric disk, which may make it easier to control the shift in frequency caused by temperature changes, as a suitable thermal expansion coefficient can be chosen for the dielectric disk. In one example, a modified resonator design for use can include a dielectric disk placed on top of a coaxial resonator made of metal. This would enable smaller filters operate at lower frequencies of below 1 GHz. However, even with this arrangement having a dielectric disk attached to a coaxial resonator, a difference in the thermal coefficients between the dielectric disk and the housing is unavoidable. Thus, expansions and contractions occurring due to changes in temperature may lead to inadequate securing or inadequate contact of the dielectric disk, which in turn may cause changes in the properties of the filter.

DISCLOSURE

Technical Problem

To resolve the problems in the background art described above, the present invention aims to provide an RF filter for improving PIMD performance where the resonator can be secured in a stable manner and the RF filter is capable of improving PIMD performance.

Technical Solution

An embodiment of the present invention provides an RF filter for improving PIMD performance that includes: a housing which has at least one cavity formed therein and includes a dielectric resonator held in the cavity; washers joined to an upper portion and a lower portion of the dielectric resonator, where the washers are shaped as circular plates and are made of a metallic material; and a cover joined to an upper portion of the housing. A washer protrusion may be formed on one side of the washer, where the washer protrusion may increase in height along a direction moving away from the center, with the washer configured to contact the cover or the housing.

A screw may protrude from one side of at least one of the washers joined to the upper portion and the lower portion of the dielectric resonator.

A male thread may be formed on an outer perimeter of the screw, a slot or a hole may be formed in the housing and the cover, the slot or hole having a female thread formed in an inner perimeter thereof corresponding to the male thread of the screw, and the screw may be inserted into the slot or hole to be joined with the cover or the housing.

The dielectric resonator and the washer may be joined by way of soldering.

The RF filter may further include a pressing member joined to the cover. An insertion area may be formed in the cover to receive the pressing member as it is inserted therethrough. A thin part having a smaller thickness compared to the main body of the cover may be formed in the insertion area. The pressing member may be inserted through the insertion area to press the thin part, and the thin part is configured to contact the washer.

The pressing member may include an elastic member capable of applying an elastic force.

The RF filter may further include a tuning bolt joined to the cover, where the tuning bolt may be inserted into the cavity.

The tuning bolt may be formed from a metallic material, and the tuning bolt may be configured such that its insertion depth is adjustable and securable.

The material of the housing and the cover may include metal.

Another embodiment of the present invention provides an RF filter for improving PIMD performance that includes: a housing which has at least one cavity formed therein and includes a metal resonator held in the cavity; a dielectric disk joined to an upper portion of the metal resonator; a washer joined to an upper portion of the dielectric disk, where the washer has an annular shape and is made of a metallic material; and a cover joined to an upper portion of the housing. A washer protrusion may be formed on one side of the washer, where the washer protrusion may increase in height along a direction moving away from the center, with the washer configured to contact the cover.

The metal resonator and the dielectric disk may be joined by way of soldering, and the dielectric disk and the washer may be joined by way of soldering.

The RF filter may further include a pressing member joined to the cover. An insertion area may be formed in the cover to receive the pressing member as it is inserted therethrough. A thin part having a smaller thickness compared to the main body of the cover may be formed in the insertion area. The pressing member may be inserted through the insertion area to press the thin part, and the thin part is configured to contact the washer.

A fastening hole may be formed in a lower surface of the metal resonator, and the metal resonator may be secured to the housing by way of a fastening member inserted through the fastening hole.

The pressing member may include an elastic member capable of applying an elastic force.

The RF filter may further include a tuning bolt joined to the cover.

The tuning bolt may be formed from a metallic material, and the tuning bolt may be configured such that its insertion depth is adjustable and securable.

The material of the housing and the cover may include metal.

A resonator protrusion may be formed on a lower surface of the metal resonator, and the metal resonator may be configured to contact the housing.

Advantageous Effects

An embodiment of the present invention makes it possible to secure the resonator in a stable manner and improve PIMD performance.

MODE FOR INVENTION

Figure 1:
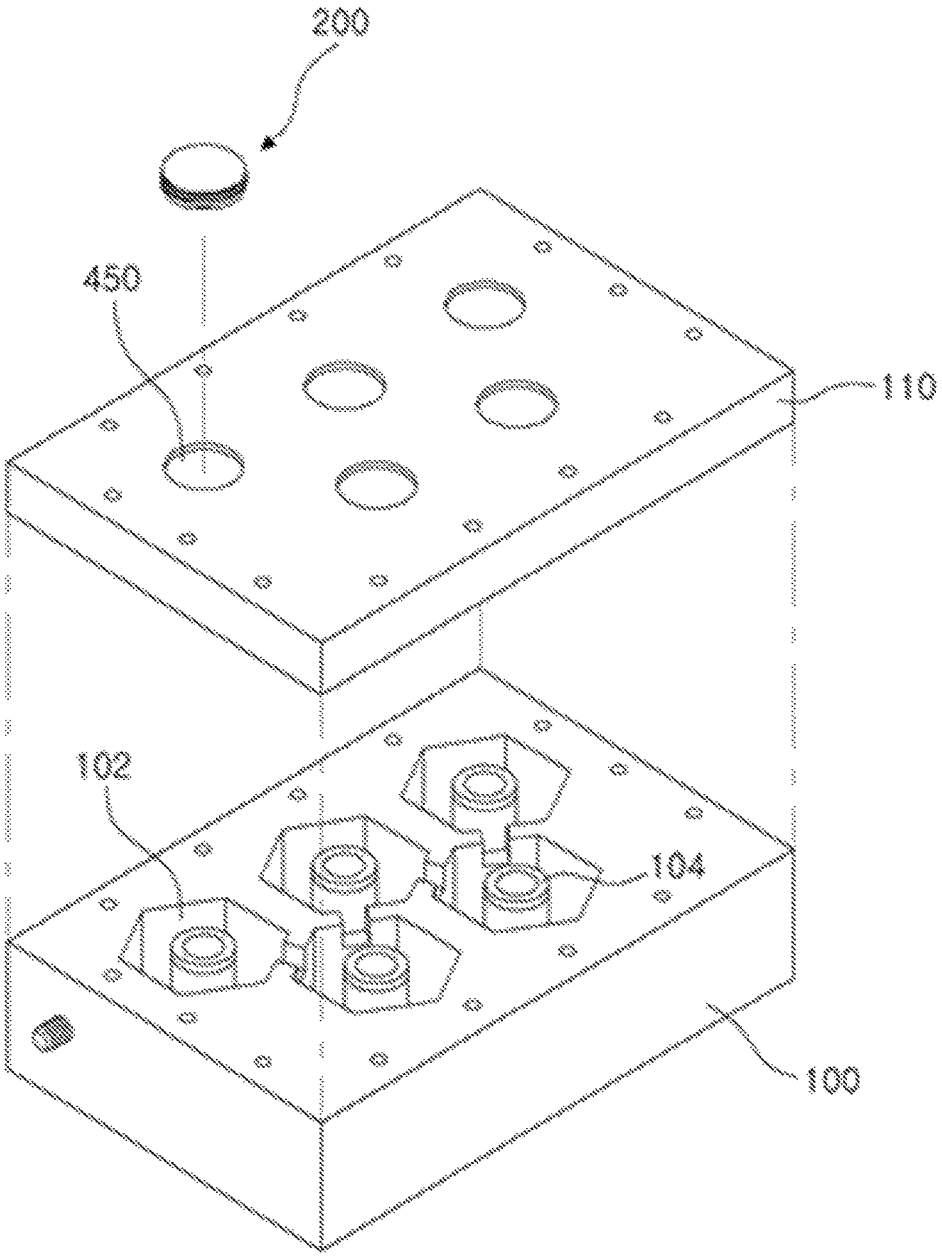
FIG. 1 is an exploded perspective view of an RF filter for improving PIMD performance according to a first disclosed embodiment of the present invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used to represent like elements.

While such terms as "first" and "second," etc., may be used to describe various elements, such elements must not be limited to the above terms. The above terms are used only to distinguish one element from another. For example, a first element may be referred to as a second element without departing from the scope of rights of the present invention, and likewise a second element may be referred to as a first element. Certain embodiments of the invention are described below in more detail with reference to the accompanying drawings.

FIG. 1 is an exploded perspective view of an RF filter for improving PIMD performance according to a first disclosed embodiment of the present invention.

Referring to FIG. 1, an RF filter for improving PIMD performance according to the first disclosed embodiment of the present invention can include a housing 100, a cover 110, dielectric resonators 104, and a multiple number of pressing members 200.

The housing 100 may serve as the main body of the filter, and a multiple number of cavities 102 may be formed inside the housing. Although FIG. 1 illustrates an example in which there are five cavities 102 formed, the number of cavities 102 can be changed as necessary. A dielectric resonator 104 may be mounted in each of the cavities 102. The dielectric resonator 104 may be made from a dielectric material and may have a generally cylindrical shape.

A washer 350 may be joined to an upper portion of the dielectric resonator 104, the washer 350 positioned to contact the cover 110 of the filter. A structure that allows stable contact between the washer 350 and the cover 110 is described herein.

The housing 100 can be made using an aluminum material as a base and applying a silver plating treatment over the base. The silver plating can be applied to provide high electrical conductivity. Of course, a housing plated with a metal other than silver, such as copper for example, can also be used.

The multiple cavities 102 may be defined by the housing 100 and by multiple partitions installed inside the housing 100. The numbers of cavities 102 and resonators 104 formed in the housing 100 are associated with the insertion loss and attenuation properties of the filter. A greater number of cavities 102 and resonators 104 can provide higher attenuation properties but can also increase insertion loss. That is, increasing the number of cavities and resonators may provide better attenuation properties but increase insertion loss, posing a trade-off between the attenuation properties and the insertion loss.

The cover 110 may be joined to the upper portion of the housing 100, which may be the open side of the housing 100. The cover 110 may be joined to the upper portion of the housing 100 to form the closed structure of the housing 100. Due to the joining of the cover 110, the inside of the filter can be shielded from electromagnetic waves. The cover 110 can also be formed by preparing a base structure of aluminum and applying a silver plating or copper plating treatment on the base structure.

The cover 110 and the housing 100 can be joined by using any of a variety of joining methods. For instance, the cover 110 can be joined to the housing 100 by using bolts or by soldering, etc.

A multiple number of insertion areas 450 may be formed in the cover 110, and into each of the multiple insertion areas 450, a pressing member 200 may be inserted.

The housing 100 and cover 110 of the filter may have a ground potential, and in order to obtain the desired electrical properties and provide a strong fastening of the dielectric resonators 104, it is necessary to tightly press the washer 350 onto the cover 110. The pressing member 200 may serve to provide the pressure needed for the tight pressing.

The positions of the insertion areas 450 formed in the cover 110 may correspond to the positions of the dielectric resonators 104. The insertion areas 450 can be formed over the dielectric resonators 104, and in cases where there are five resonators installed, there may be five insertion areas 450 formed in the cover.

The pressing members 200 may each be inserted into an insertion area 450, with the number of pressing members 200 corresponding to the number of insertion areas 450. The pressing member 200 may be inserted into the insertion area 450 such that it can press the cover 110 and thus provide a stable contact between the cover 110 and the washer 350.

Figure 2:
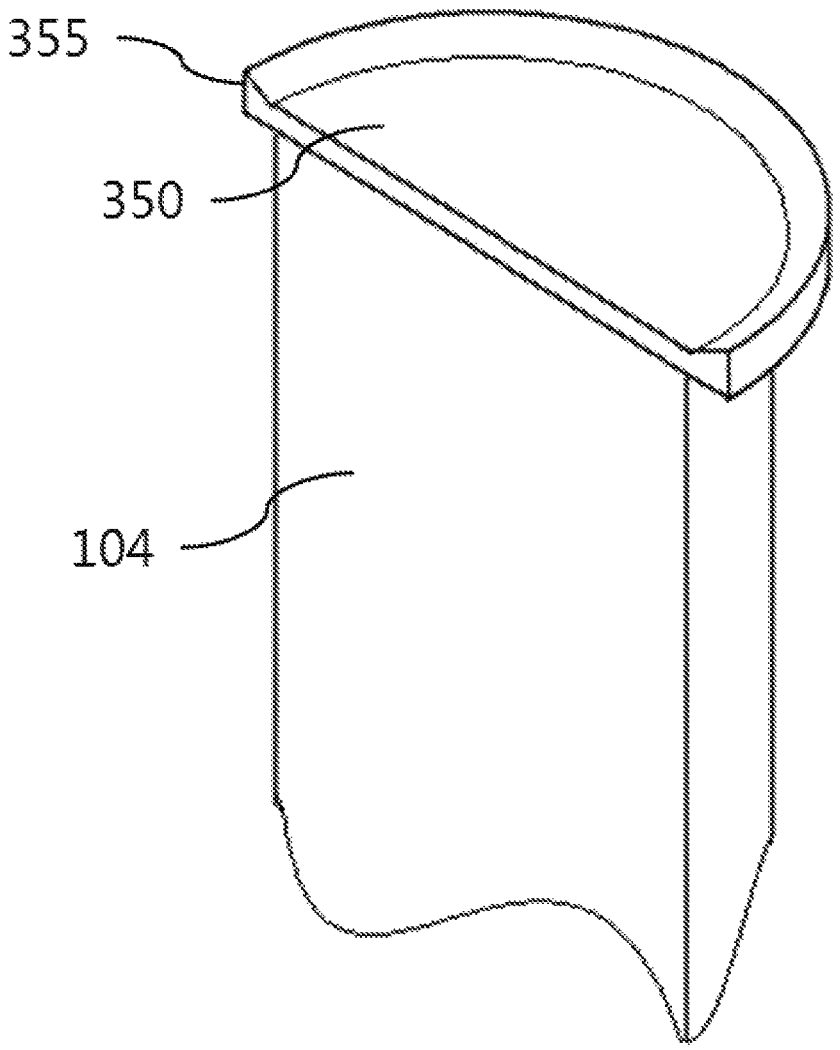
FIG. 2 illustrates the structure of a dielectric resonator in an RF filter for improving PIMD performance according to the first disclosed embodiment of the present invention.

FIG. 2 illustrates the structure of a dielectric resonator in an RF filter for improving PIMD performance according to the first disclosed embodiment of the present invention.

Referring to FIG. 2, in an RF filter for improving PIMD performance according to the first disclosed embodiment of the present invention, a washer 350 may be joined to the dielectric resonator 104. The washer 350 can be joined to the dielectric resonator 104 by using soldering. An RF filter for improving PIMD performance according to the first disclosed embodiment of the present invention can thus have the washer 350 joined to the dielectric resonator 104 using soldering, to thereby reduce the occurrence of PIMD and improve PIMD performance. Also, metal plating, such as silver plating for example, can be applied to the top and bottom of the dielectric resonator 104.

The washer 350 can be formed from a metallic material and can be shaped as a circular plate. Also, on one side of the washer 350, a washer protrusion 355 can be formed protruding in the direction of the cover 110, where the washer protrusion 355 can be shaped such that it increases in height along a direction moving away from the center. Because of the washer protrusion 355, the washer 350 can be formed with a greater height on the outer side compared to the height on the inner side. The combined height of the dielectric resonator 104 and the washer 350 joined together may correspond to the height of the inside of the housing, allowing the washer 350 to contact the cover 110 of the filter. As the washer protrusion 355 of the washer 350 is pressed by the cover 110, the dielectric resonator 104 joined to the washer 350 can be firmly secured.

Also, as the washer 350 has the washer protrusion 355 contacting the cover 110 instead of having the entire upper surface contacting the cover 110, the region of contact between the washer 350 and the cover 110 may have the form of a line rather than a plane. Thus, an RF filter for improving PIMD performance according to the first disclosed embodiment of the invention may be structured such that the washer 350 and the cover 110 engage in linear contact instead of planar contact, thereby allowing improvements in the PIMD performance.

Figure 3:
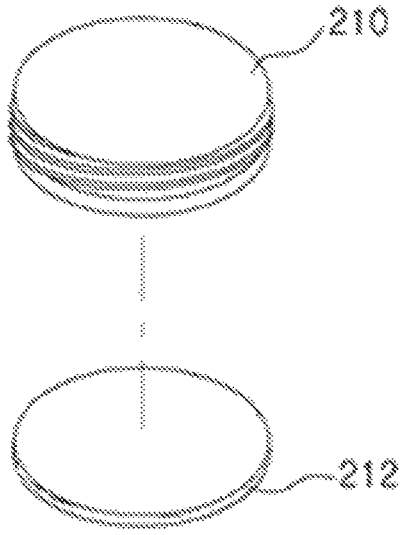
FIG. 3 is an exploded perspective view of a pressing member applicable to an RF filter for improving PIMD performance according to the first disclosed embodiment of the present invention.

FIG. 3 is an exploded perspective view of a pressing member applicable to an RF filter for improving PIMD performance according to the first disclosed embodiment of the present invention.

Referring to FIG. 3, a pressing member 200 according to the first disclosed embodiment of the present invention can include an insert part 210 and an elastic member 212.

The pressing member 200 may be inserted through the insertion area of the cover 110, where the insert part 210 can have a cylindrical structure with a male thread formed on the outer perimeter. The insert part 210 may be made from a metallic material.

The elastic member 212 may be joined to a lower portion of the insert part 210. For example, the elastic member 212 can be joined to the lower portion of the insert part 210 by bonding. Of course, various joining methods other than bonding can also be used.

The elastic member 212 can have the shape of a circular plate. The elastic member 212 is an element for pressing the cover 110. Materials such as silicone-based rubber, for example, can be used for the elastic member 212.

Figure 4:
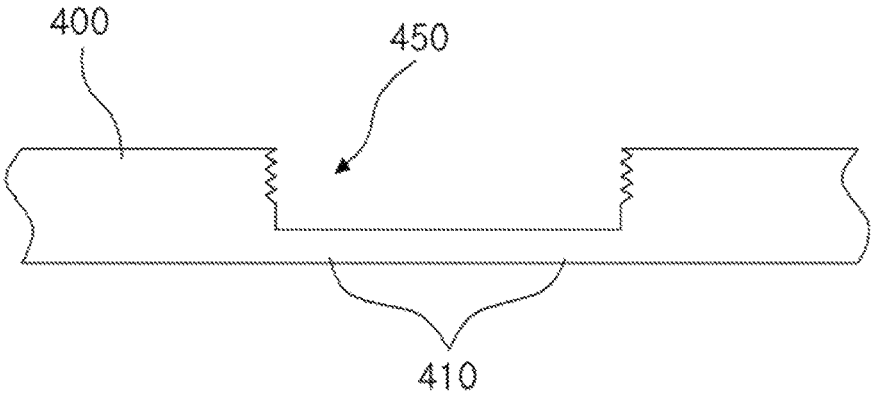
FIG. 4 is a cross-sectional view of an area where a pressing member is to be applied in an RF filter for improving PIMD performance according to the first disclosed embodiment of the present invention.

FIG. 4 is a cross-sectional view of an area where a pressing member is to be applied in an RF filter for improving PIMD performance according to the first disclosed embodiment of the present invention.

Referring to FIG. 4, the cover of an RF filter for improving PIMD performance according to the first disclosed embodiment of the present invention can include a main body 400 and a thin part 410.

The main body 400 may have a particular thickness, and at a particular part of the main body 400, the thin part 410 may be formed, which has a smaller thickness than that of the main body 400. By forming the thin part 410 that has a smaller thickness compared to the main body 400, an insertion area 450 may be formed in the main body 400 at which the pressing member 200 can be inserted.

Referring to FIG. 4, the thin part 410 may be shaped as a circular plate. The thickness of the thin part 410 can be set to such an extent that a deformation can occur according to the pressing applied by the pressing member 200. A thread may be formed in the inner perimeter of the insertion area 450 that is formed due to the difference in thickness between the main body 400 and the thin part 410.

Figure 5:
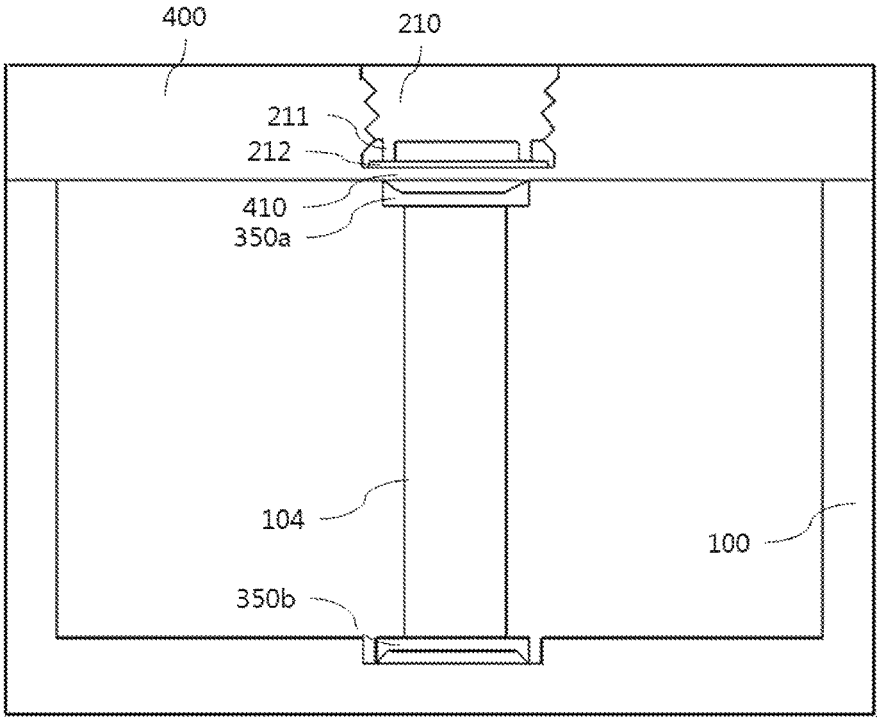
FIG. 5 is a cross-sectional view of a cavity in an RF filter for improving PIMD performance according to the first disclosed embodiment of the present invention.

FIG. 5 is a cross-sectional view of a cavity in an RF filter for improving PIMD performance according to a first disclosed embodiment of the present invention.

Referring to FIG. 5, the pressing member 200 may be inserted in the insertion area 450 that is formed by the thickness difference between the main body 400 and the thin part 410 of the filter cover. The pressing member 200 can be inserted into the insertion area 450 by way of a screw joint. Using the thread formed in the inner perimeter of the insertion area 450 and the thread formed on the outer perimeter of the insert part 210, the insert part 210 may be rotated and inserted into the insertion area. The rotation of the insert part 210 may be performed until the insert part 210 is completely placed in the insertion area 450.

While it is not illustrated in the drawings, a hole can be formed in the cover 110 for joining a tuning bolt. The tuning bolt can be inserted through the cover 110 by a screw joint. The tuning bolt can be inserted by rotation, and the insertion depth of the tuning bolt can be adjusted based on the degree of rotation. The tuning bolt may be inserted into the housing 100, the tuning bolt used for tuning the properties of the filter. By adjusting the insertion depth of the tuning bolt, it is possible to tune the resonance frequency of the filter. When the desired resonance frequency is obtained by the tuning, the position of the tuning bolt may be secured by using a nut.

When the pressing member 200 is inserted in the insertion area 450, the elastic member 212 joined to the lower portion of the insert part 210 may press the thin part 410 of the insertion area 450. Since the thin part 410 may have a thickness that allows a deformation in shape according to the pressure applied, the thin part may be directed in a downward direction according to the pressing of the elastic member 212. It is also possible to form a pressing protrusion 211, for pressing a particular region of the elastic member 212, at a lower portion of the insert part 210, so as to have the pressing protrusion 211 apply pressure on the elastic member 212.

The elastic member 212, made from silicone rubber for example, may provide an elastic force, making it possible to press on the thin part 410 continuously.

A washer 350*a* may be joined to the upper end of the dielectric resonator 104 by way of soldering, and a washer 350*b* may be joined also to the lower end by way of soldering. The thin part 410 of the cover 110 may contact the washer protrusion 355 of the washer 350*a*. The height of the dielectric resonator 104 may be similar to the height of the inside of the housing 100. The washer 350*b* may be soldered to the lower end of the dielectric resonator 104 to allow the thin part 410 of the cover 110 to contact the washer protrusion 355 of the washer 350*a*, and indentations can be formed in the housing 100 according to the thicknesses of the washers 350*a*, 350*b*.

The elastic member 212 of the pressing member 200 may press the thin part 410 as it is inserted into the insertion area 450, and due to the pressing by the pressing member 200, the washer protrusion 355 can be made to contact the thin part 410 in a more stable manner. In addition, for effective pressing, the pressing protrusion 211 can be positioned in alignment with the washer protrusion 355.

As the elastic member 212 of the pressing member 200 is made of an elastic material, such as silicone rubber for example, it is capable of pressing the thin part 410 continuously due to its restorative force. Therefore, even if a vibration, etc., is applied to the filter, the washer 350*a* can maintain contact with the thin part 410 in a stable manner.

As described above, an RF filter for improving PIMD performance according to the first disclosed embodiment of the present invention can have washers 350*a*, 350*b* soldered to the upper end and lower end of a dielectric resonator 104 and can have the pressing member 200 joined to the cover 110 such that the elastic member 212 presses the thin part 410. As a result, the washer 350*a* at the upper end of the dielectric resonator 104 may be secured in tight contact with the thin part 410, while the washer 350*b* at the lower end of the dielectric resonator 104 may be secured in tight contact with the housing 100.

While FIG. 5 illustrates the manner in which the dielectric resonator 104 and washer 350 contact the cover 110 within one cavity, the structure shown in FIG. 5 can be formed in each of the cavities.

An RF filter for improving PIMD performance according to a second disclosed embodiment of the present invention can include a washer on which a screw is formed.

Figure 6:
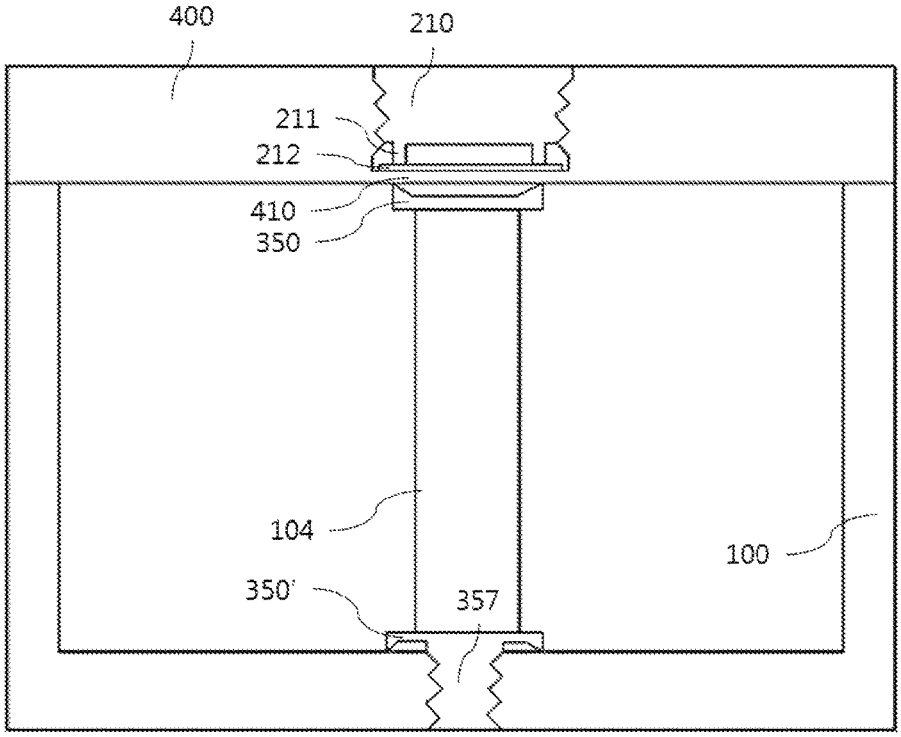
FIG. 6 is a cross-sectional view of a cavity in an RF filter for improving PIMD performance according to a second disclosed embodiment of the present invention.

FIG. 6 is a cross-sectional view of a cavity in an RF filter for improving PIMD performance according to the second disclosed embodiment of the present invention.

Referring to FIG. 6, in an RF filter for improving PIMD performance according to the second disclosed embodiment of the present invention, a screw 357 having a thread formed therein can be formed on the washer 350' joined to the lower end of the dielectric resonator 104. The screw 357 can be formed protruding and extending along the same direction as the washer protrusion 355. Also, a hole in which a thread shaped in correspondence to the screw 357 can be formed in the housing 100, and the screw 357 can be inserted into the hole formed in the housing 100. Thus, the washer 350' at the lower end of the dielectric resonator 104 may be firmly secured to the housing 100 by way of the screw 357, while the washer 350 at the upper end of the dielectric resonator 104 can be secured to the cover 110 by the same structure as that of the RF filter for improving PIMD performance according to the first disclosed embodiment of the present invention.

In this way, the dielectric resonator 104 soldered to the washers 350, 350' can be firmly secured to the housing 100 and the cover 110.

In an RF filter for improving PIMD performance according to a third disclosed embodiment of the present invention, a washer having a screw can also be joined to the upper end of the dielectric resonator.

Figure 7:
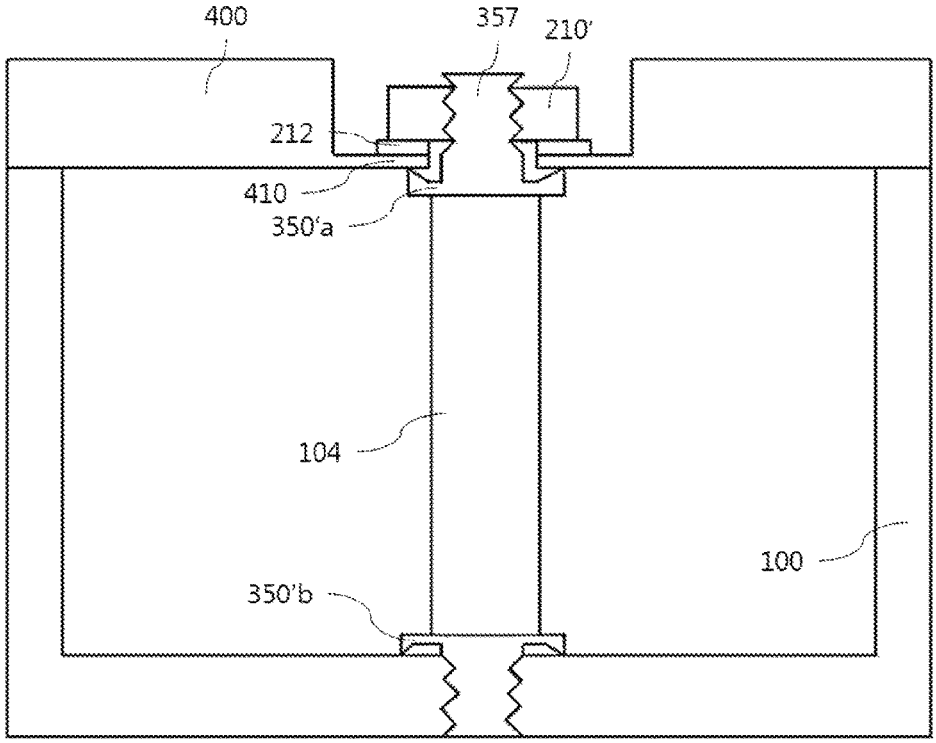
FIG. 7 is a cross-sectional view of a cavity in an RF filter for improving PIMD performance according to a third disclosed embodiment of the present invention.

FIG. 7 is a cross-sectional view of a cavity in an RF filter for improving PIMD performance according to the third disclosed embodiment of the present invention.

Referring to FIG. 7, in an RF filter for improving PIMD performance according to the third disclosed embodiment of the present invention, screws 357 having threads formed therein can be formed on the washers 350'*a*, 350'*b*. The screw 357 can be formed protruding and extending along the same direction as the washer protrusion 355. Also, holes in which threads shaped in correspondence to the screw 357 can be formed in the housing 100 and the cover 110 or the insert part 210', and the screw 357 can be inserted into the holes formed in the housing 100 and the cover 110 or insert part 210'. Thus, the washer 350'*b* at the lower end of the dielectric resonator 104 may be firmly secured to the housing 100 by way of the screw 357, while the washer 350'*a* at the upper end of the dielectric resonator 104 can be secured by joining with the cover 110 or the insert part 210'.

In an RF filter for improving PIMD performance according to the third disclosed embodiment of the present invention, the insert part 210' can have the shape of a nut, while holes can be formed in the elastic member 212 and the thin part 410. When the screw 357 of the washer 350'*a* is inserted through the insert part 210', the insert part 210' can press on the elastic member 212, the elastic member 212 can press on the thin part 410, and consequently the thin part 410 can maintain contact with the washer protrusion 355 of the washer 350'*a* in a stable manner, so that the washer 350'*a* may be secured to the cover 110.

Thus, the dielectric resonator 104 soldered to the washers 350'*a*, 350'*b* can be firmly secured to the housing 100 and the cover 110.

Figure 8:
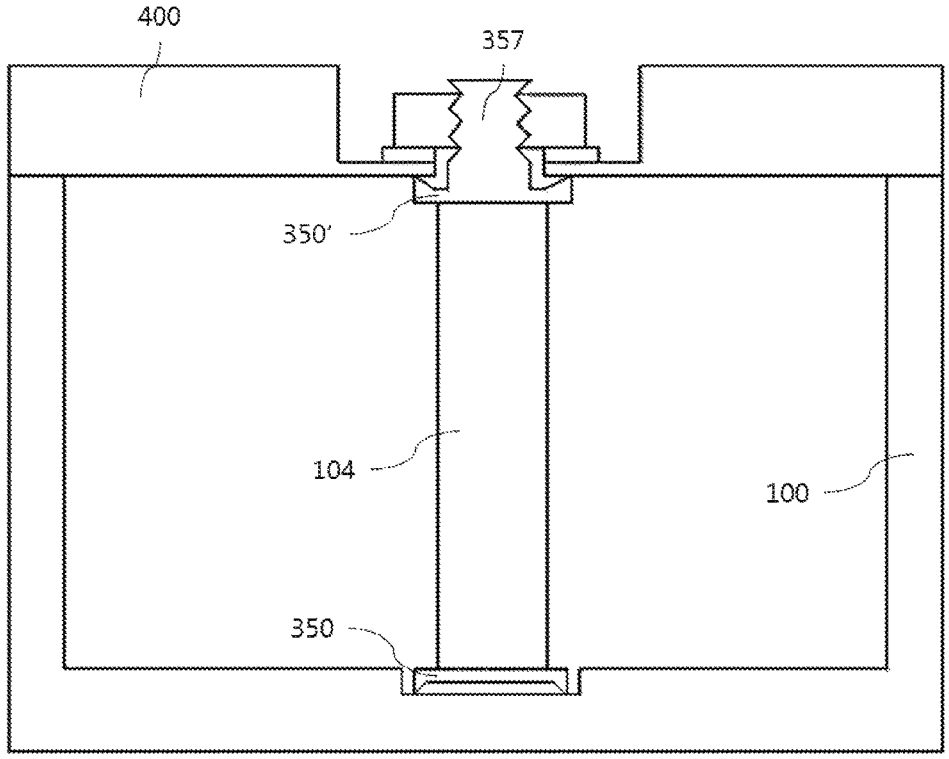
FIG. 8 is a cross-sectional view of a cavity in an RF filter for improving PIMD performance according to a fourth disclosed embodiment of the present invention.

FIG. 8 is a cross-sectional view of a cavity in an RF filter for improving PIMD performance according to a fourth disclosed embodiment of the present invention.

Referring to FIG. 8, in an RF filter for improving PIMD performance according to the fourth disclosed embodiment of the invention, the washer 350 joined to the lower end of the dielectric resonator 104 may not have a screw formed thereon, and only the washer 350' joined to the upper end of the dielectric resonator 104 may a screw 357 formed thereon.

Thus, in the RF filter for improving PIMD performance according to the fourth disclosed embodiment of the invention, the dielectric resonator 104 can be secured to and kept in contact with the housing 100 by way of a structure similar to that described for the first disclosed embodiment and can be secured to and kept in contact with the cover 110 by way of a structure similar to that described for the third disclosed embodiment.

Figure 9:
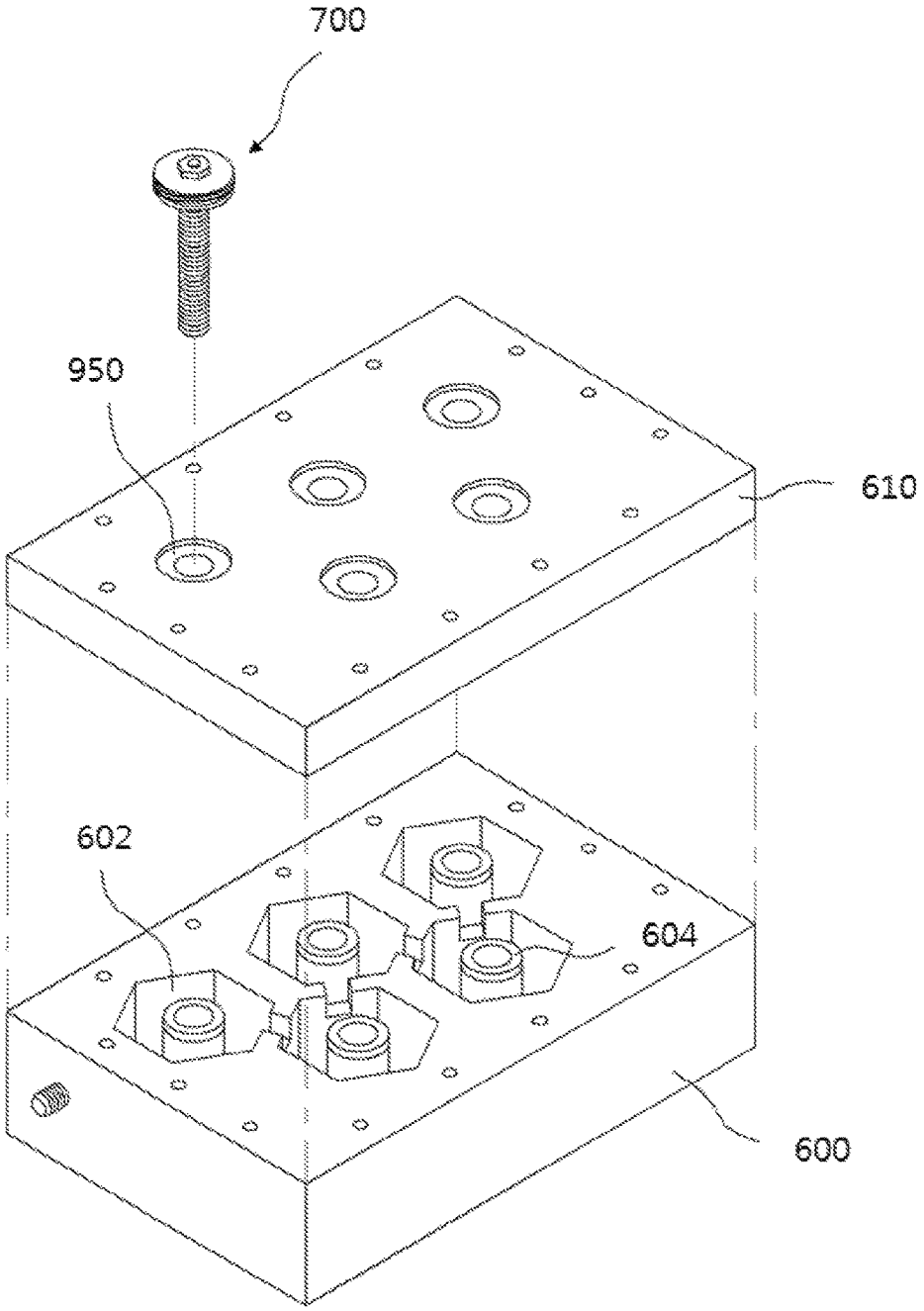
FIG. 9 is an exploded perspective view of an RF filter for improving PIMD performance according to a fifth disclosed embodiment of the present invention.

FIG. 9 is an exploded perspective view of an RF filter for improving PIMD performance according to a fifth disclosed embodiment of the present invention.

Referring to FIG. 9, an RF filter for improving PIMD performance according to the fifth disclosed embodiment of the present invention can include a housing 600, a cover 610, metal resonators 604, and a multiple number of pressing members 700.

The housing 600 may serve as the main body of the filter, and a multiple number of cavities 602 may be formed inside the housing. Although FIG. 9 illustrates an example in which there are five cavities 602 formed, the number of cavities 602 can be changed as necessary. A metal resonator 604 may be mounted in each of the cavities 602. The metal resonator 604 can be made from a metallic material and can be structured to have a generally cylindrical shape with a cylindrical slot formed inside.

A dielectric disk 800 may be joined to an upper portion of the metal resonator 604. The dielectric disk 800 may be used to increase the capacitance formed between the metal resonator 604 and the cover 610 of the filter. By using the dielectric disk 800 to increasing the capacitance, it is possible to fabricate the metal resonator 604 in a smaller size. A washer 850 may be joined to an upper portion of the dielectric disk 800, the washer 850 positioned to contact the cover 610 of the filter. A structure that allows stable contact between the washer 850 and the cover 610 is described herein.

The housing 600 can be made using an aluminum material as a base and applying a silver plating treatment over the base. The silver plating can be applied to provide high electrical conductivity. Of course, a housing 600 plated with a metal other than silver, such as copper for example, can also be used.

The multiple cavities 602 may be defined by the housing 600 and by multiple partitions installed inside the housing 600. The numbers of cavities 602 and resonators 604 formed in the housing 600 are associated with the insertion loss and attenuation properties of the filter. A greater number of cavities 602 and resonators 604 can provide higher attenuation properties but can also increase insertion loss. That is, increasing the number of cavities and resonators may provide better attenuation properties but increase insertion loss, posing a trade-off between the attenuation properties and the insertion loss.

The cover 610 may be joined to the upper portion of the housing 600, which may be the open side of the housing 600. The cover 610 may be joined to the upper portion of the housing 600 to form the closed structure of the housing 600. Due to the joining of the cover 610, the inside of the filter can be shielded from electromagnetic waves. The cover 610 can also be formed by preparing a base structure of aluminum and applying a silver plating or copper plating treatment on the base structure.

The cover 610 and the housing 600 can be joined by using any of a variety of joining methods. For instance, the cover 610 can be joined to the housing 600 by using bolts or by soldering, etc.

A multiple number of insertion areas 950 may be formed in the cover 610, and into each of the multiple insertion areas 950, a pressing member 700 may be inserted.

The housing 600 and cover 610 of the filter may have a ground potential, and in order to obtain the desired electrical properties and provide a strong fastening of the dielectric disk 800, it is necessary to tightly press the washer 850 onto the cover 610. The pressing member 700 may serve to provide the pressure needed for the tight pressing.

The positions of the insertion areas 950 formed in the cover 610 may correspond to the positions of the metal resonators 604. The insertion areas 950 can be formed over the metal resonators 604, and in cases where there are five metal resonators installed, there may be five insertion areas 950 formed in the cover.

The pressing members 700 may each be inserted into an insertion area 950, with the number of pressing members 700 corresponding to the number of insertion areas 950. The pressing member 700 may be inserted into the insertion area 950 such that it can press the cover 610 and thus provide a stable contact between the cover 610 and the washer 850.

Figure 10:
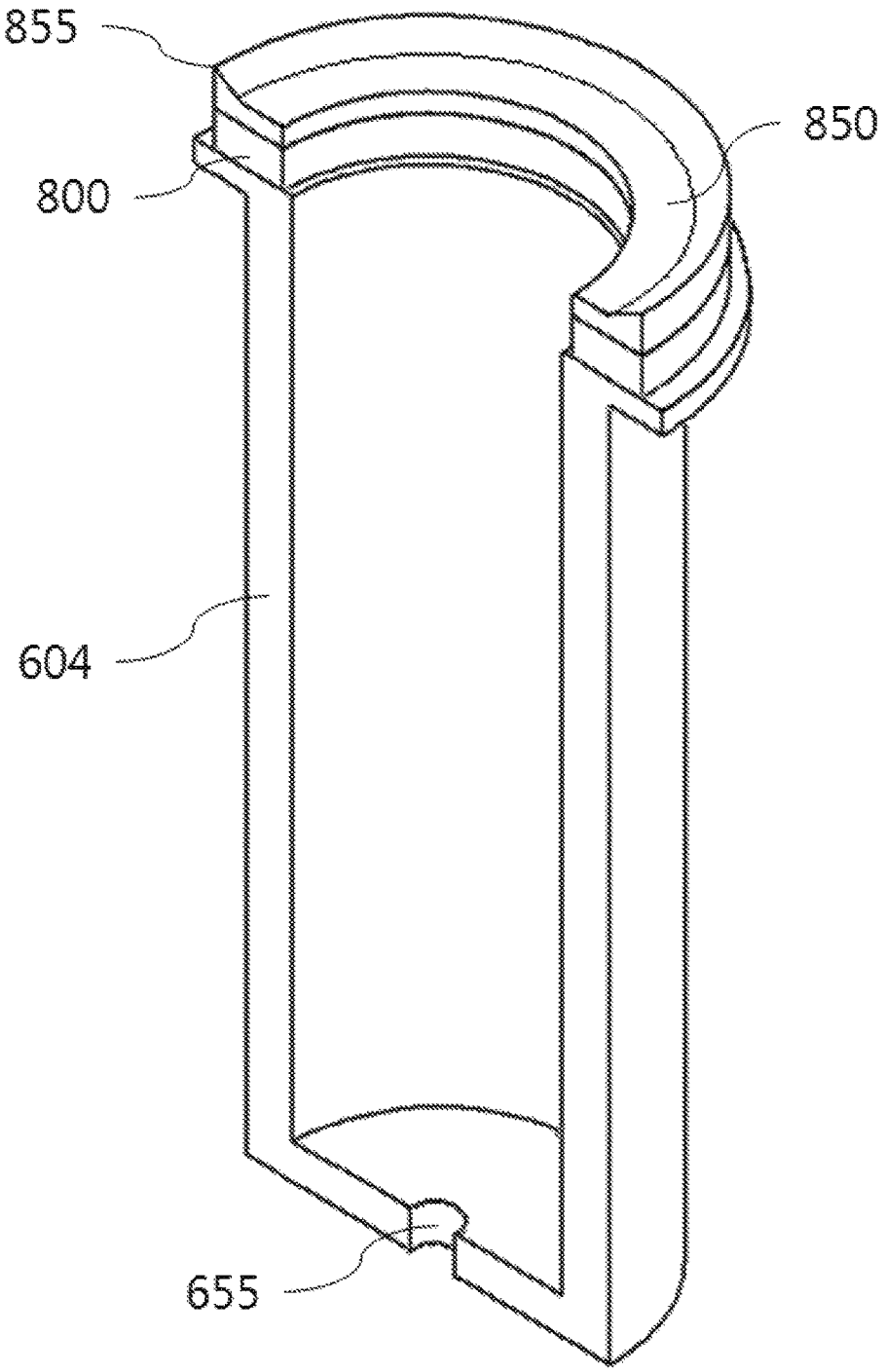
FIG. 10 illustrates the structure of a metal resonator in an RF filter for improving PIMD performance according to the fifth disclosed embodiment of the present invention.

FIG. 10 illustrates the structure of a metal resonator in an RF filter for improving PIMD performance according to the fifth disclosed embodiment of the present invention.

Referring to FIG. 10, in an RF filter for improving PIMD performance according to the fifth disclosed embodiment of the present invention, a dielectric disk 800 may be joined to the metal resonator 604. The dielectric disk 800 can be joined to the metal resonator 604 by using soldering. An RF filter for improving PIMD performance according to the fifth disclosed embodiment of the present invention can thus have the dielectric disk 800 joined to the metal resonator 604 using soldering, to thereby reduce the occurrence of PIMD (passive intermodulation distortion) and prevent degradations in properties. Also, metal plating, such as silver plating for example, can be applied to the top and bottom of the dielectric disk 800.

The dielectric disk 800 may have an annular shape and have a hole formed therein. The hole inside the dielectric disk and the hole or slot formed in the metal resonator 604 are where a tuning bolt, described later on, is to be inserted.

The dielectric disk 800 may be a dielectric having a high dielectric constant, and because of the high dielectric constant of the ceramic dielectric, the capacitance formed between the metal resonator 604 and the cover 610 may be increased. The sizes of the metal resonators 604 and the cavities 602 may be determined by the operating frequency of the filter. The lower the operating frequency, the larger the sizes needed for the metal resonators 604 and the cavities 602.

The dielectric disk 800 may increase the capacitance between the cover 610 and the metal resonator 604, so that the sizes of the metal resonators 604 and cavities 602 can be reduced compared to the case in which there are no dielectric disks 800.

At an upper portion of the dielectric disk 800, a washer 850 may be joined. The washer 850 can be joined to the upper portion of the dielectric disk 800 by using soldering. An RF filter for improving PIMD performance according to the fifth disclosed embodiment of the present invention can thus have the washer 850 joined to the dielectric disk 800 using soldering, to thereby reduce the occurrence of PIMD and prevent degradations in properties. Also, metal plating, such as including silver plating for example, can be applied to the top and bottom of the dielectric disk 800.

The washer 850 can be formed from a metallic material and can have an annular shape with a hole formed inside. Also, on one side of the washer 850, a washer protrusion 855 can be formed protruding in the direction of the cover 610, where the washer protrusion 855 can be shaped such that it increases in height along a direction moving away from the center. Because of the washer protrusion 855, the washer 850 can be formed with a greater height on the outer side compared to the height on the inner side. The combined height of the metal resonator 604, dielectric disk 800, and washer 850 joined together may correspond to the height of the inside of the housing, allowing the washer 850 to contact the cover 610 of the filter. As the washer protrusion 855 of the washer 850 is pressed by the cover 610, the dielectric disk 800 and metal resonator 604 joined to the washer 850 can be firmly secured.

Also, as the washer 850 has the washer protrusion 855 contacting the cover 610 instead of having the entire upper surface contacting the cover 610, the region of contact between the washer 850 and the cover 610 may have the form of a line rather than a plane. Thus, an RF filter for improving PIMD performance according to the fifth disclosed embodiment of the invention may be structured such that the washer 850 and the cover 610 engage in linear contact instead of planar contact, thereby allowing improvements in the PIMD performance.

Also, a fastening hole 655 can be formed in the lower surface of the metal resonator 604. A fastening member 650 can be inserted into the fastening hole 655 to secure the metal resonator 604 onto the housing.

Figure 11:
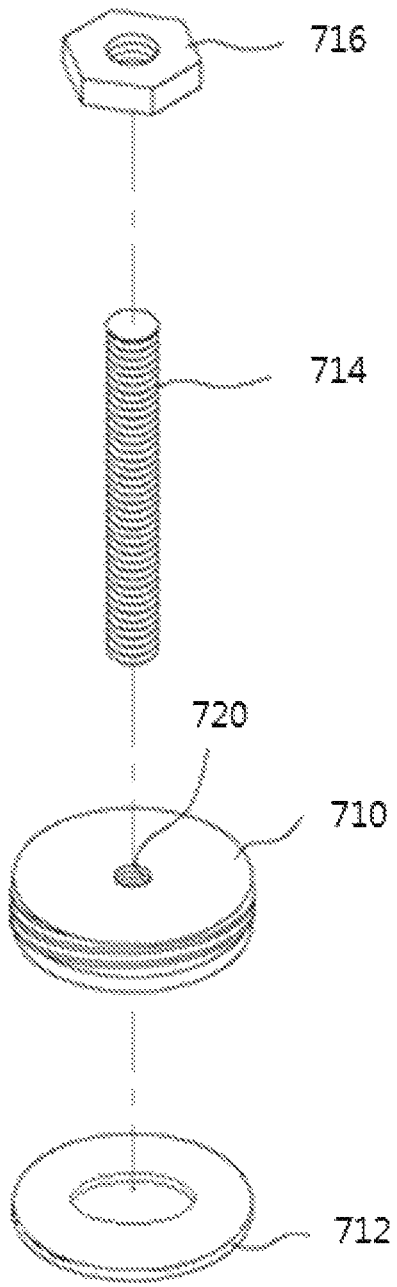
FIG. 11 is an exploded perspective view of a pressing member applicable to an RF filter for improving PIMD performance according to the fifth disclosed embodiment of the present invention.

FIG. 11 is an exploded perspective view of a pressing member applicable to an RF filter for improving PIMD performance according to the fifth disclosed embodiment of the present invention.

Referring to FIG. 11, a pressing member 700 according to the fifth disclosed embodiment of the present invention can include an insert part 710, an elastic member 712, and a tuning bolt 714.

The pressing member 700 may be inserted through the insertion area of the cover 610, where the insert part 710 can have a cylindrical structure with a male thread formed on the outer perimeter. The insert part 710 may be made from a metallic material.

An insertion hole 720 may be formed in a center portion of the insert part 710, and the tuning bolt 714 may be joined at the insertion hole 720. A thread may be formed in the inner perimeter of the insertion hole 720 of the insert part 710, and a thread may also be formed on the outer perimeter of the tuning bolt 714, so that the tuning bolt may be inserted through the insertion hole 720 by way of a screw joint. The tuning bolt 714 can be inserted through the insertion hole 720 by rotation, and the insertion depth can be adjusted based on the degree of rotation.

The elastic member 712 may be joined to a lower portion of the insert part 710. For example, the elastic member 712 can be joined to the lower portion of the insert part 710 by bonding. Of course, various joining methods other than bonding can also be used.

The elastic member 712 can have an annular shape with a hole formed in the center. The elastic member 712 may be the component for pressing the cover 610, and a rubber of a silicone material, for example, can be used for the elastic member 712.

Figure 12:
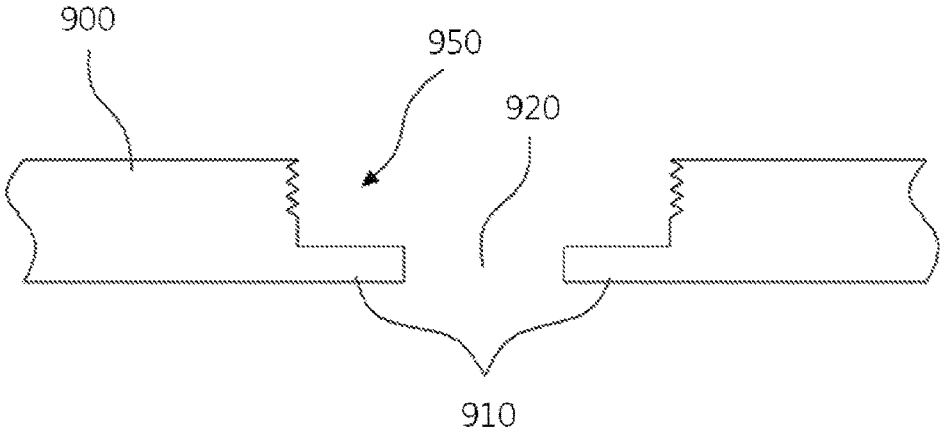
FIG. 12 is a cross-sectional view of an area where a pressing member is to be applied in an RF filter for improving PIMD performance according to the fifth disclosed embodiment of the present invention.

FIG. 12 is a cross-sectional view of an area where a pressing member is to be applied in an RF filter for improving PIMD performance according to a fifth disclosed embodiment of the present invention.

Referring to FIG. 12, the cover of an RF filter for improving PIMD performance according to an embodiment of the invention can include a main body 900, a thin part 910, and a hole 920.

The main body 900 may have a particular thickness, and at a particular part of the main body 900, the thin part 910 may be formed, which has a smaller thickness than that of the main body 900. By forming the thin part 910 that has a smaller thickness compared to the main body 900, an insertion area 950 may be formed in the main body 900 at which the pressing member 700 can be inserted.

Referring to FIG. 12, the thin part 910 may an annular shape and may have a hole 920 formed in the center portion of the thin part 910. The thickness of the thin part 910 may be set to such an extent that a deformation can occur according to the pressing by the pressing member 700. The thin part 910 may preferably take the shape of a circular ring, and the hole 920 may also preferably be of a circular shape.

The insertion area 950, formed by the difference in thickness between the main body 900 and the thin part 910, may have a thread formed in its inner perimeter.

Figure 13:
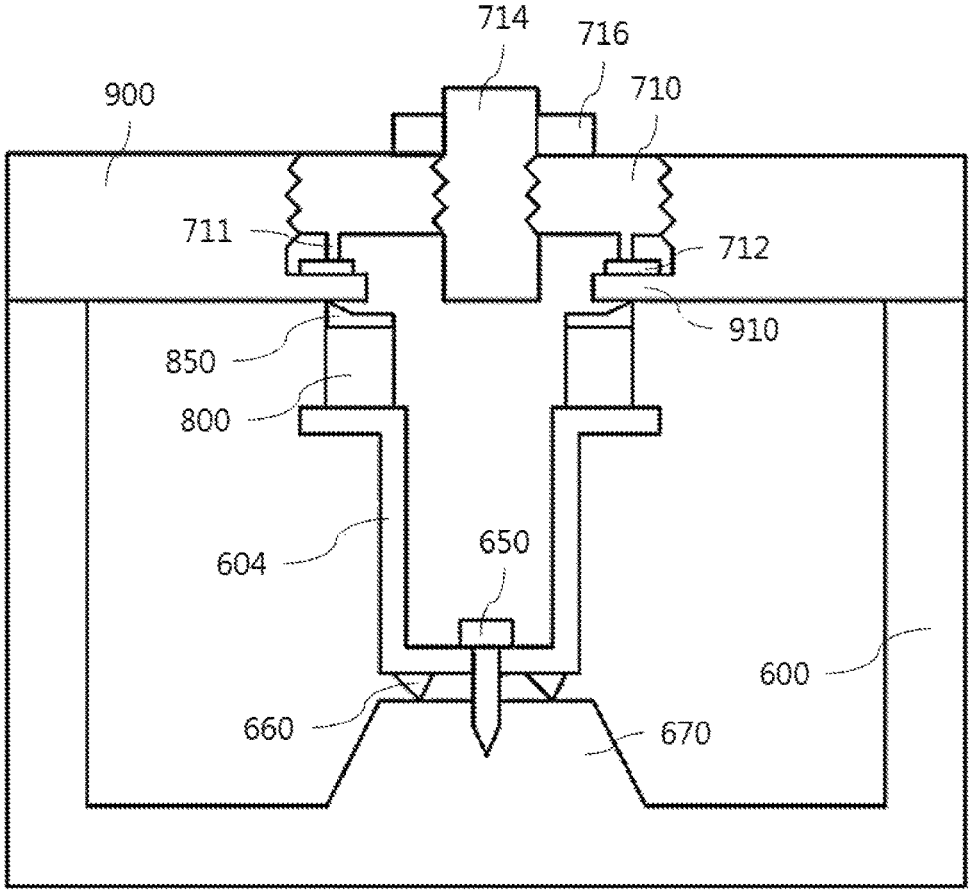
FIG. 13 is a cross-sectional view of a cavity in an RF filter for improving PIMD performance according to the fifth disclosed embodiment of the present invention.

FIG. 13 is a cross-sectional view of a cavity in an RF filter for improving PIMD performance according to a fifth disclosed embodiment of the present invention.

Referring to FIG. 13, the pressing member 700 may be inserted in the insertion area 950 that is formed by the thickness difference between the main body 900 and the thin part 910 of the filter cover. The pressing member 700 can be inserted into the insertion area 950 by way of a screw joint. Using the thread formed in the inner perimeter of the insertion area 950 and the thread formed on the outer perimeter of the insert part 710, the insert part 710 of the pressing member 700 may be rotated and inserted into the insertion area. The rotation of the insert part 710 may be performed until the insert part 710 is completely placed in the insertion area 950.

In the hole 920 formed in the insertion area 950, a tuning bolt 714 may be inserted. The tuning bolt 714 may be inserted into the housing 600 through the hole 920, the tuning bolt 714 used for tuning the resonance frequency of the filter. By adjusting the insertion depth of the tuning bolt 714, it is possible to tune the resonance frequency of the filter. When the desired resonance frequency is obtained by the tuning, the position of the tuning bolt 714 may be secured by using a nut 716.

When the pressing member 700 is inserted in the insertion area 950, the elastic member 712 joined to the lower portion of the insert part 710 may press the thin part 910 of the insertion area 950. Since the thin part 910 may have a thickness that allows a deformation in shape according to the pressure applied, the thin part may be directed in a downward direction according to the pressing of the elastic member 712. It is also possible to form a pressing protrusion 711, for pressing a particular region of the elastic member 712, at a lower portion of the insert part 710, so as to have the pressing protrusion 711 apply pressure on the elastic member 712.

The elastic member 712, made from silicone rubber for example, may provide an elastic force, making it possible to press on the thin part 910 continuously.

The thin part 910 of the cover 610 may contact the washer protrusion 855 of the washer 850. The height of the metal resonator 604 may be similar to the height of the inside of the housing 600.

In order that the thin part 910 of the cover 610 may contact the washer protrusion 855 of the washer 850, a housing protrusion 670 can be formed on the housing 600 at a portion under the metal resonator 604, and also a resonator protrusion 660 can be formed on a lower surface of the metal resonator 604. In particular, the resonator protrusion 660 can facilitate the firm securing of the metal resonator 604 relative to the housing 600. Furthermore, similar to the washer 850, the structure providing linear contact instead of planar contact with respect to the housing 600 can improve PIMD properties.

The elastic member 712 of the pressing member 700 may press the thin part 910 as it is inserted into the insertion area 950, and due to the pressing by the pressing member 700, the washer protrusion 855 can be made to contact the thin part 910 in a more stable manner. In addition, for effective pressing, the pressing protrusion 711 can be positioned in alignment with the washer protrusion 855.

As the elastic member 712 of the pressing member 700 is made of an elastic material, such as silicone rubber for example, it is capable of pressing the thin part 910 continuously due to its restorative force. Therefore, even if a vibration, etc., is applied to the filter, the washer 850 can maintain contact with the thin part 910 in a stable manner.

Also, a fastening member 650 can be inserted into the fastening hole 655 of the metal resonator 604 to secure the metal resonator 604 onto the housing.

While FIG. 13 illustrates the manner in which the metal resonator 604 and the dielectric disk 800 maintain contact and the washer 850 and the cover 610 maintain contact within one cavity, the structure shown in FIG. 13 can be formed in each of the cavities.

Figure 14:
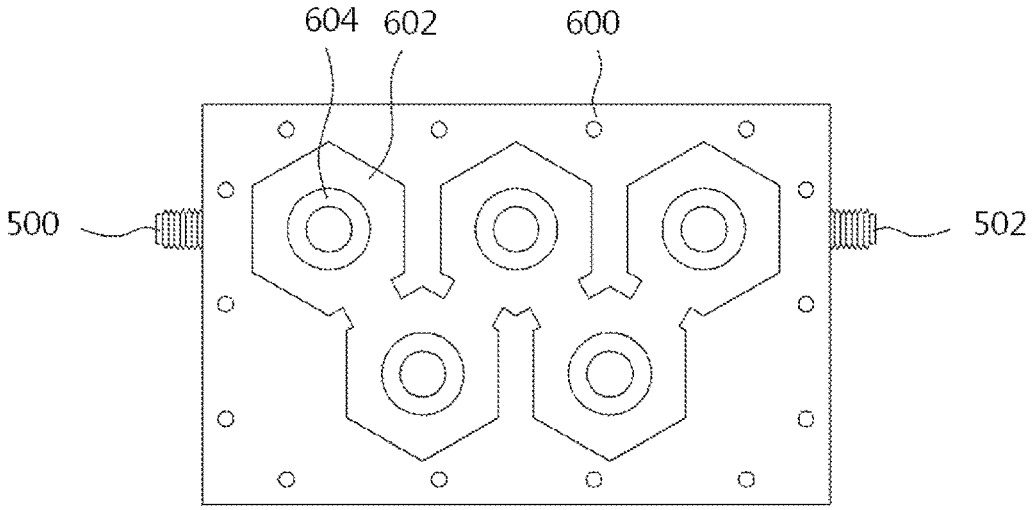
FIG. 14 is a plan view of the interior of an RF filter for improving PIMD performance according to the fifth disclosed embodiment of the present invention.

FIG. 14 is a plan view of the interior of an RF filter for improving PIMD performance according to a fifth disclosed embodiment of the present invention.

Referring to FIG. 14, the cavity filter may be equipped with an input port 500 and an output port 502, where the RF signals for filtering may be inputted through the input port 500, and the filtered output signals may be outputted through the output port 502.

FIG. 14 illustrates an example in which there are five cavities 602 and five resonators 604, and in which the filtering is performed by way of resonance in each of the cavities. A metal resonator 604 may be included in each cavity 602, and the resonance frequency achieved in each cavity may be determined by the size and form of the metal resonator 604.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

The invention claimed is:

1. An RF filter for improving PIMD performance, the RF filter comprising:

a housing having at least one cavity formed therein, the housing comprising a dielectric resonator held in the cavity;

washers joined to an upper portion and a lower portion of the dielectric resonator, the washers shaped as circular plates and made of a metallic material; and a cover joined to an upper portion of the housing, the washer has a washer protrusion formed on one side thereof, the washer protrusion increasing in height along a direction moving away from the center, and the washer is configured to contact the cover or the housing.

2. The RF filter for improving PIMD performance according to claim 1, wherein the dielectric resonator and the washer are joined by way of soldering.

3. The RF filter for improving PIMD performance according to claim 1, wherein a material of the housing and the cover is metal.

4. The RF filter for improving PIMD performance according to claim 1, wherein at least one of the washers joined to the upper portion and the lower portion of the dielectric resonator has a screw protruding from one side thereof.

5. The RF filter for improving PIMD performance according to claim 4, wherein the screw has a male thread formed on an outer perimeter thereof, the housing or the cover has a slot or hole formed therein, the slot or hole has a female thread formed in an inner perimeter thereof corresponding to the male thread of the screw, and the screw is inserted into the slot or hole to be joined with the cover or the housing.

6. The RF filter for improving PIMD performance according to claim 1, the RF filter further comprising a pressing member joined to the cover, wherein the cover has an insertion area formed therein, the insertion area configured to receive the pressing member inserted therethrough, the insertion area has a thin part formed therein, the thin part having a smaller thickness compared to a main body of the cover, the pressing member configured to be inserted through the insertion area to press the thin part, and the thin part is configured to contact the washer.

7. The RF filter for improving PIMD performance according to claim 6, wherein the pressing member comprises an elastic member capable of applying an elastic force.

8. The RF filter for improving PIMD performance according to claim 1, further comprising a tuning bolt joined to the cover, wherein the tuning bolt is inserted into the cavity.

9. The RF filter for improving PIMD performance according to claim 8, wherein the tuning bolt is formed from a metallic material, and the tuning bolt is configured such that an insertion depth thereof is adjustable and securable.

10. An RF filter for improving PIMD performance, the RF filter comprising:

a housing having at least one cavity formed therein, the housing comprising a metal resonator held in the cavity;

a dielectric disk joined to an upper portion of the metal resonator;

a washer joined to an upper portion of the dielectric disk, the washer having an annular shape and made of a metallic material; and a cover joined to an upper portion of the housing, the washer has a washer protrusion formed on one side thereof, the washer protrusion increasing in height along a direction moving away from the center, and the washer is configured to contact the cover.

11. The RF filter for improving PIMD performance according to claim 10, wherein the metal resonator and the dielectric disk are joined by way of soldering, and the dielectric disk and the washer are joined by way of soldering.

12. The RF filter for improving PIMD performance according to claim 10, wherein the metal resonator has a fastening hole formed in a lower surface thereof, and the metal resonator is secured to the housing by way of a fastening member inserted through the fastening hole.

13. The RF filter for improving PIMD performance according to claim 10, wherein a material of the housing and the cover is metal.

14. The RF filter for improving PIMD performance according to claim 10, wherein the metal resonator has a resonator protrusion formed on a lower surface thereof, and the metal resonator is configured to contact the housing.

15. The RF filter for improving PIMD performance according to claim 10, the RF filter further comprising a pressing member joined to the cover, wherein the cover has an insertion area formed therein, the insertion area configured to receive the pressing member inserted therethrough, the insertion area has a thin part formed therein, the thin part having a smaller thickness compared to a main body of the cover, the pressing member configured to be inserted through the insertion area to press the thin part, and thin part is configured to contact the washer.

16. The RF filter for improving PIMD performance according to claim 15, wherein the pressing member comprises an elastic member capable of applying an elastic force.

17. The RF filter for improving PIMD performance according to claim 10, further comprising a tuning bolt joined to the cover.

18. The RF filter for improving PIMD performance according to claim 17, wherein the tuning bolt is formed from a metallic material, and the tuning bolt is configured such that an insertion depth thereof is adjustable and securable.

* * * * *